US007775462B2

(12) United States Patent
Herring et al.

(10) Patent No.: US 7,775,462 B2
(45) Date of Patent: Aug. 17, 2010

(54) SPRAY DEVICE

(75) Inventors: William Peter Herring, Bath (GB); James Moore, Somerset (GB)

(73) Assignee: Hornbeam Ivy Limited, Frome (GB)

( * ) Notice: Subject to any disclaimer, the term of this patent is extended or adjusted under 35 U.S.C. 154(b) by 790 days.

(21) Appl. No.: 11/496,507

(22) Filed: Aug. 1, 2006

(65) Prior Publication Data

US 2007/0045449 A1 Mar. 1, 2007

(30) Foreign Application Priority Data

Aug. 8, 2005 (GB) ..... 0516265.6

(51) Int. Cl.
*B05B 7/12* (2006.01)

(52) U.S. Cl. ..... 239/414; 239/282; 239/407; 239/413; 239/581.1; 137/801; 137/625.41; 4/677

(58) Field of Classification Search ..... 4/675–678, 4/695; 137/625.41, 801, 625.4; 239/407, 239/413–415, 588, 581.1, 581.2, 525, 282
See application file for complete search history.

(56) References Cited

U.S. PATENT DOCUMENTS 209,539 A * 11/1878 Abbatt ..... 137/616.7
713,144 A * 11/1902 Pierce et al. ..... 137/625.17
1,432,501 A * 10/1922 Tuozzoli ..... 239/433
2,878,489 A * 3/1959 Graham ..... 4/677
5,349,987 A 9/1994 Shieh
5,417,348 A 5/1995 Perrin et al.
5,806,771 A 9/1998 Loschelder et al.
5,906,319 A 5/1999 Crowl
6,119,947 A 9/2000 Couture et al.
6,341,617 B1 1/2002 Wilson
6,641,061 B1 11/2003 Hsieh
2002/0162586 A1 11/2002 Perrin
2003/0001028 A1 1/2003 Brattoli et al.
2004/0088786 A1 * 5/2004 Malek et al. ..... 4/677
2004/0123910 A1 7/2004 Yardley
2004/0139544 A1 * 7/2004 Williams et al. ..... 4/675
2004/0226088 A1 11/2004 Ouyoung
2006/0117477 A1 * 6/2006 Rosko ..... 4/676

FOREIGN PATENT DOCUMENTS

EP 1350573 A1 10/2003

* cited by examiner

*Primary Examiner*—Jason J Boeckmann
(74) *Attorney, Agent, or Firm*—Stites & Harbison PLLC; Douglas E. Jackson

(57) ABSTRACT

A spray device for use as a supplementary fluid output, having a mixing chamber for receiving and mixing fluid from two input supplies which supplies mixed fluid to a spray head through a flexible conduit. The relative proportions of input supplies received in the mixing chamber is controlled by a mix controller having a mix actuator which is connected to a mix valve associated with the mixing chamber by an upstanding rotatable sleeve. The spray device is mounted on a hole in a work surface by mounting means. The flexible conduit and the upstanding rotatable sleeve pass through the hole in the work surface and a bore in the mounting means. The mix controller may control the rate of fluid flow through the device.

17 Claims, 11 Drawing Sheets

SPRAY DEVICE

BACKGROUND OF THE INVENTION

1. Field of the Invention

The present invention relates to hand sprays used e.g. on kitchen sinks as alternative or additional water sources to the main tap or faucet.

2. Summary of the Prior Art

Typical hand sprays (also known as side sprays) include a spray head, e.g. similar to a shower head, for delivering fluid (e.g. water) flow through a nozzle. Traditionally, the hand sprays are located next to the primary tap or taps of a kitchen sink. Side sprays are commonly used with mixer taps. The spray head typically included a hand grip to allow the user to direct the flow as desired. Some hand sprays are removably mountable on the work surface (sink holding or containing surface) and have a flexible fluid delivery hose to allow more freedom of movement. Typically, known hand sprays are operable using a simple thumb switch, which controls a valve to stop or release fluid flow through the nozzle. The thumb switch allows controlled one-handed operation.

Early hand sprays were connected to a single source, e.g. the cold water supply pipe for the primary tap. The lack of control over hand spray output temperature was undesirable, so a number of proposals to provide mixed (e.g. hot and cold) water, preferably controllably mixed water, at the hand spray were made.

In one proposal an automatic diverter valve is incorporated into a mixer tap. The diverter valve operates to deflect mixed water into the hand spray when the hand spray is operated. To fit in the mixer tap, the automatic diverter was small, which meant that in time it was liable to become clogged with limescale and therefore reduce flow to the spray.

Automatic diverters made the use of bridge mixer taps difficult. To address this, GB 2361047 proposes a bridge mixer tap with a mixer chamber separate from the traditional mixer passageway between tap pillars. The extra mixer chamber is located under the work surface, where it is fed by hot and cold water supplies controllable by valves (also located under the work surface) operable by the tap operators on each pillar. The mixing chamber possesses two outputs: one feeds a hand spray via a flexible conduit, the other sends mixed water up through both pillars to be ejected from the main tap spout. A valve in the mixing chamber shuttles between two positions according to pressure differential experienced in the mixing chamber (due to operative status of the hand spray) to direct flow through a respective one of the outputs. In this arrangement, long operator shafts are required to extend down the pillars to their respective valves, and the visible mixing passageway is redundant because the water is already mixed when it reaches that passageway.

GB 2394525 proposes a bridge mixer tap arranged to address the above-mentioned problems by providing a built in diverter valve in the traditional bridge mixing chamber (above the work surface). The diverter valve can divert mixed flow down a passageway coaxial with one of the pillar input supplies so that it flows back beneath the work surface after mixing, where it is sent through a flexible conduit to feed a hand spray device. This avoids having a redundant bridge mixer passageway, but increases the complexity of the tap units. For example, the size of the bridge mixer may be enlarged to house the diverter valve. The temperature of the mixed water is controlled by the tap operators on the pillars.

SUMMARY OF THE INVENTION

The present invention aims to ameliorate one or more of the above-mentioned problems. One aim is to provide an alternative configuration of a device having a mixer valve beneath the work surface. Another aim is to provide independent temperature control for the hand spray output. A further aim is to provide a more compact mixer valve operating mechanism.

It is to be noted that the terms "above" and "below" as used hereafter refer to positions of elements relative to each other, and should not be taken as limiting their orientation relative to the earth.

At its most general, the present invention provides a mixer valve (mixing chamber) dedicated to the hand spray. Independent temperature control, i.e. control of the input flow, usually from a plurality, e.g. two, input supplies for the hand spray output is therefore made possible. The invention is preferably for use with kitchen sink side sprays, e.g. hand sprays mountable next to, typically on the same surface as, a main kitchen tap.

Thus, according to the invention there may be provided a spray device for use as a supplementary fluid output, the spray device including: a spray unit having a spray head arranged to output a user-directable fluid flow; and a mixing chamber arranged to receive at least two fluid input supplies and to be in fluid communication with the spray unit to provide a fluid output supply to the spray head; wherein the spray unit includes: a flow controller operable to control fluid flow through the device; and a mix controller operable to control the fluid input supplies received in the mixing chamber. The spray device may be a hand spray suitable for use as a supplementary device with a main tap or faucet e.g. for use on a kitchen sink. In other words, the spray device is a distinct entity from a main fluid outlet, such as a mixer tap. The spray device is preferably mountable on a work surface e.g. kitchen sink or shelf. It may be mounted close to e.g. reachable from the main fluid outlet. Alternatively, the spray device may be provided as a stand-alone device, e.g. with its own separate sink. The present invention allows for a separate spray device that is not necessarily connected or associated with a main tap unit.

The mounting of components of the spray device above and below the work surface is normally achieved by using mounting means for attaching the device to the work surface. The mounting means may be a housing and backing nut on opposite sides of the work surface. The components of the spray device are positioned relatively above or below the mounting means of the spray device and are thus located above or below the work surface when the mounting means is attached to it. The fluid communication may pass through a bore in the mounting means.

Therefore, there may be provided a spray device for use as a supplementary fluid output, the spray device including: mounting means for attaching the spray device to a work surface; a spray head positioned above the mounting means arranged to output a user-directable fluid flow; a mixing chamber positioned below the mounting means arranged to receive and mix fluid from at least two fluid input supplies and to be in fluid communication with the spray head through an output conduit, to provide a fluid output supply to the spray head; and a mix controller having a mix actuator positioned above the mounting means, the mix actuator being arranged to operate mix control means communicable with one or more mix valves associated with the mixing chamber, to control the relative proportions of the fluid input supplies received in the mixing chamber; wherein the mix control means and output conduit pass through a bore in the mounting means.

Preferably, the spray device is mounted on a single hole in the work surface. This may minimise the visible footprint of the device, which may make it more aesthetically pleasing. The bore in the mounting means may be aligned with the hole in the work surface, so that the control means and output conduit also passes through the hole in the work surface.

Preferably, the spray device includes a housing mountable on (e.g. fixed to) the work surface. The spray head is preferably detachable from the housing to give the user greater control in fluid flow direction. The housing may be the mounting means. Alternatively, the housing may be attached to the mounting means.

Preferably, the fluid communication between the spray head and mixing chamber includes a flexible conduit. The conduit may be extendible, or its length may be selected to allow the spray head to be moved away from the housing. The fluid output supply from the mixing chamber is preferably carried by the flexible conduit.

The spray head may be mounted to a distal end of the flexible conduit such that it is angularly orientable relative to the flexible conduit. This enables a user to have improved directional control of the spray head, without unnecessarily bending/twisting of the flexible conduit.

Preferably, the mixing chamber is located below the work surface. Elements of the spray device on display in use may be kept to a minimum. For example, the fluid communication between the spray head and mixing chamber may lie substantially below the work surface when the spray head is mounted on its housing. The single hole discussed above may be formed in the work surface for the flexible conduit feeding the spray head to pass. The housing may have a through hole formed therein for locating over the hole in the work surface, thereby allowing the flexible conduit to pass through. In this way, the housing may be mounted on the hole in the work surface to minimise the footprint of the device on display in use. The spray head and flexible conduit may be of the conventional type.

The spray device may include a flow controller operable to control the fluid flow (i.e. the rate of fluid flow) through the spray device. The flow controller is preferably arranged as an on/off device to either permit or prevent fluid flow out of the spray head. The flow controller may include a flow valve in the spray head. The flow valve may be operable by a press switch e.g. located on the spray head and actuable by the user's thumb when the user holds the spray head. The flow valve may be of the conventional type. Alternatively, the flow controller may be combined with the mix controller. In this preferred case, the spray device has a combined controller operable to control fluid flow into and away from the mixing chamber. The combined controller preferably has an off configuration where no fluid flow occurs, and an on configuration where fluid may flow through the device and the mix of fluid input supplies received by the mixing chamber is controllable. In a convenient embodiment, the combined controller may initially offer volume control of cold fluid only and then temperature control of full-flow fluid output. For further control, an additional flow valve in the spray head, e.g. operable using the thumb switch described above, may be used with the combined controller.

Preferably, the spray head is configured such that the direction of fluid entering the spray head, and the direction of fluid leaving the spray head are at an acute angle to one another (e.g. this may conveniently be achieved by a handle portion of the spray head being curved). In this configuration, when the spray head is held in an "up" position in which fluid enters the spray head in a vertically upwards direction, the nozzle will direct fluid in an inclined downwards direction. Thus, a user holding the spray head in an "up" position is less likely to produce accidental spillage since fluid flow will be directed downwards. Also, if the housing mounts the spray head in an "up" position, fluid flow will be directed downward from the spray head whilst the spray head is in the housing. This is beneficial because it enables a user to adjust the flow and/or temperature settings of fluid flowing from the device, prior to detaching the spray head from its housing, without causing unnecessary spillage, particularly if the downward fluid flow is directed to a fluid receiving device (e.g. a sink). This benefit can also realised by any configuration of the spray device in which the housing mounts the spray head such that fluid is directed in a downwards direction.

The spray head may comprise a spray head flow valve which has an on state in which liquid is able to flow through the spray head and an off state in which liquid is not able to flow through the spray head. The spray head flow valve may be biased to the on state so that it acts as a pause valve (i.e. so that the default setting of the valve is to allow water to flow through the spray head). This encourages a user to turn off the device using the flow controller rather than the spray head flow valve. This prevents the spray head being accidentally left in a pressurised situation by a user. The spray head flow valve may be actuated by a push button.

A characteristic of the present invention is a mix controller operable to control the fluid input supplies to the mixing chamber. This may be control of the relative proportion of fluid from each fluid input supply permitted into the mixing chamber. Preferably, the mix controller controls input to the mixing chamber independently of fluid input to the main tap. The mix controller preferably controls the input from a plurality of, e.g. two, typically hot and cold, input supplies to the mixing chamber. Preferably, the mix controller is arranged to operate a mixer valve to control relative proportions of fluid received in the mixing chamber from separate input supplies. For example, the mix controller may be able to direct 100% hot water or 100% cold water or a mixture of the two into the mixing chamber. Preferably, the mix controller is arranged to vary the input proportions in a continuous, e.g. linear, fashion.

Thus, while the flow controller may be operable to allow fluid to flow through the device, the mix controller may be operable to control the proportions of flow inputs into the mixing chamber, i.e. the mix controller may control the content of the fluid flowing through the device.

The flow input supplies may arrive in the mixing chamber through cartridge valves, e.g. of the conventional ceramic disc type, with the mix controller arranged to control the cartridge valves.

As explained above, the mix controller may also perform the function of the flow controller in that it may be operable to prevent fluid from entering the mixing chamber.

Preferably, the mix controller includes an actuator mounted on the housing e.g. located on (above) the work surface. The actuator is preferably arranged to operate control means communicable with the mixing chamber below the work surface. The control means may include physical connection to valve or valves associated with the mixing chamber such that operation of the actuator is directly transferred to operation of the valve or valves. Preferably, the physical connection of the control means extends through the same hole (i.e. the single hole) in the work surface as the flexible tube carrying the fluid output supply to the spray head. By sharing this space, the number of components on view to the user (i.e. above the work surface) can be kept low, which may improve the overall appearance of the device. In a convenient embodiment, the actuator may be arranged to rotate an upstanding sleeve about an axis. The sleeve may act as the control means, i.e. it may be directly connected to a valve in the mixing chamber. The actuator may be a rotatable ring coupled to the sleeve, the ring being rotatable by a protruding (e.g. radially protruding) lever. Preferably, the rotation axis is coaxial with the hole in the housing through which the spray head feed conduit (flexible tube carrying the output fluid supply from the mixing chamber) is arranged to travel. Thus, the feed conduit may pass through the actuator sleeve on its route from the mixing chamber below the work surface to the spray head above the work surface.

A longitudinal (axially extending) opening is preferably formed in the sleeve to receive the feed conduit. The circumferential extent of the opening is preferably selected to avoid interfering with e.g. constricting movement of or affecting flow through the feed conduit for the spray head. The axial extent of the opening is preferably selected to avoid excessive bending of the feed conduit as it travels through the sleeve and out of the housing.

The mixer valve may be conventional. Preferably, the actuator sleeve is operably coupled to a rotatable control disc which may act as a barrier between the fluid input supplies and a mixing space for mixing the inputs. The control disc may include a slot or slots formed therein arranged to align with input supply ports according to the rotation angle of the plate to permit fluid from the port(s) into the mixing space. The control disc may also include an output hole in fluid communication with the feed conduit to allow fluid to exit the mixing space. Alternatively, the mixer valve may include a pair of ceramic discs, e.g. of the conventional type, with the mix controller being operable to rotate the discs relative to one another, e.g. to align holes formed through them so that fluid can enter the mixing chamber.

As indicated above, the spray device may comprise a flow controller in addition to the mix controller (i.e. not a combined flow and mix controller). The flow controller may be arranged similarly to the mix actuator. The flow controller may have a flow actuator positioned above the work surface (e.g. on the housing) and may be arranged to operate flow control means communicable with one or more flow valves associated with the mixing chamber, to control the rate of fluid flow through the device, with the flow control means passing through the work surface (i.e. passing through the bore in the mounting means). The flow control means may be a physical connection to the flow valve(s) and may be a rotatable upstanding sleeve, with the fluid communication passing through the sleeve. The sleeve may include an axially extending opening. If the flow actuator is a sleeve, it may be arranged coaxially with the sleeve of the mix controller.

In another aspect of the invention, the above spray device may be provided as part of a mixer tap assembly e.g. kitchen tap assembly having a main tap outlet. Preferably, the assembly includes a main mixing chamber having an output in fluid communication with the main tap outlet, the main mixing chamber being separate from the mixing chamber of the spray device. Likewise, the inputs to the main mixing chamber may be controllable separately from, i.e. independently of, the mix controller of the spray device. Alternatively, the main tap outlet may be a non-mixing tap (e.g. a hot tap or a cold tap).

In another aspect, there may be provided a mixer valve having: a mixing chamber mountable beneath a work surface for mixing fluid received from two inputs in fluid communication with the mixing chamber; a flow output in fluid communication with the mixing chamber to provide an outlet for the mixed fluid, the flow output including an output conduit for carrying fluid to above the work surface; and a mix controller operable to control fluid input received in the mixing chamber, the mix controller having an actuator mountable on or above the work surface and arranged to operate control means which communicate through the work surface with the mixing chamber to perform the fluid input control, wherein the control means and the output conduit share a common path through the work surface.

The mixer valve may be mounted to the work surface by mounting means, with the control means and output conduit passing through a bore in the mounting means. Thus, according to this aspect there may be provided a mixer valve having: mounting means for attaching the mixer valve to a work surface; a mixing chamber positioned below the mounting means arranged to receive and mix fluid from at least two fluid input supplies; an output conduit in fluid communication with the mixing chamber to provide an outlet for the mixed fluid; and a mix controller having a mix actuator positioned above the mounting means, the mix actuator being arranged to operate mix control means communicable with one or more mix valves associated with the mixing chamber, to control the relative proportions of the fluid input supplies received in the mixing chamber; wherein the mix control means and output conduit pass through a bore in the mounting means.

Preferably, the control means includes a physical connection to the mixing chamber, e.g. directly to control valve or valves at the inputs to the mixing chamber. In this case, the output conduit and control means may pass through a common hole, e.g. single hole, in the work surface. This minimises the space required for connection to an outlet device, e.g. hand spray, faucet or the like. By locating the mixing chamber below the work surface, the minimum number of components of the device it feeds may be above the work surface. It is preferable to provide both the mix controller actuator and fluid output above the work surface in order to be accessible to the user.

Preferably, the control means includes an upstanding rotatable sleeve of the type described above, i.e. adapted to receive the output conduit (e.g. a flexible tube) therethrough. Although rotational operation is described and preferred because it matches the movement typically required to operate valve or valves at the mixing chamber inputs, other types of operation, e.g. axial pull up/push down arrangements are feasible.

The mixer valve may be provided as part of an assembly in which the mixer valve is mounted to a work surface.

BRIEF DESCRIPTION OF THE DRAWINGS

Two examples of the present invention are discussed in detail with reference to the accompanying drawings, in which.

DETAILED DESCRIPTION

Figure 1:
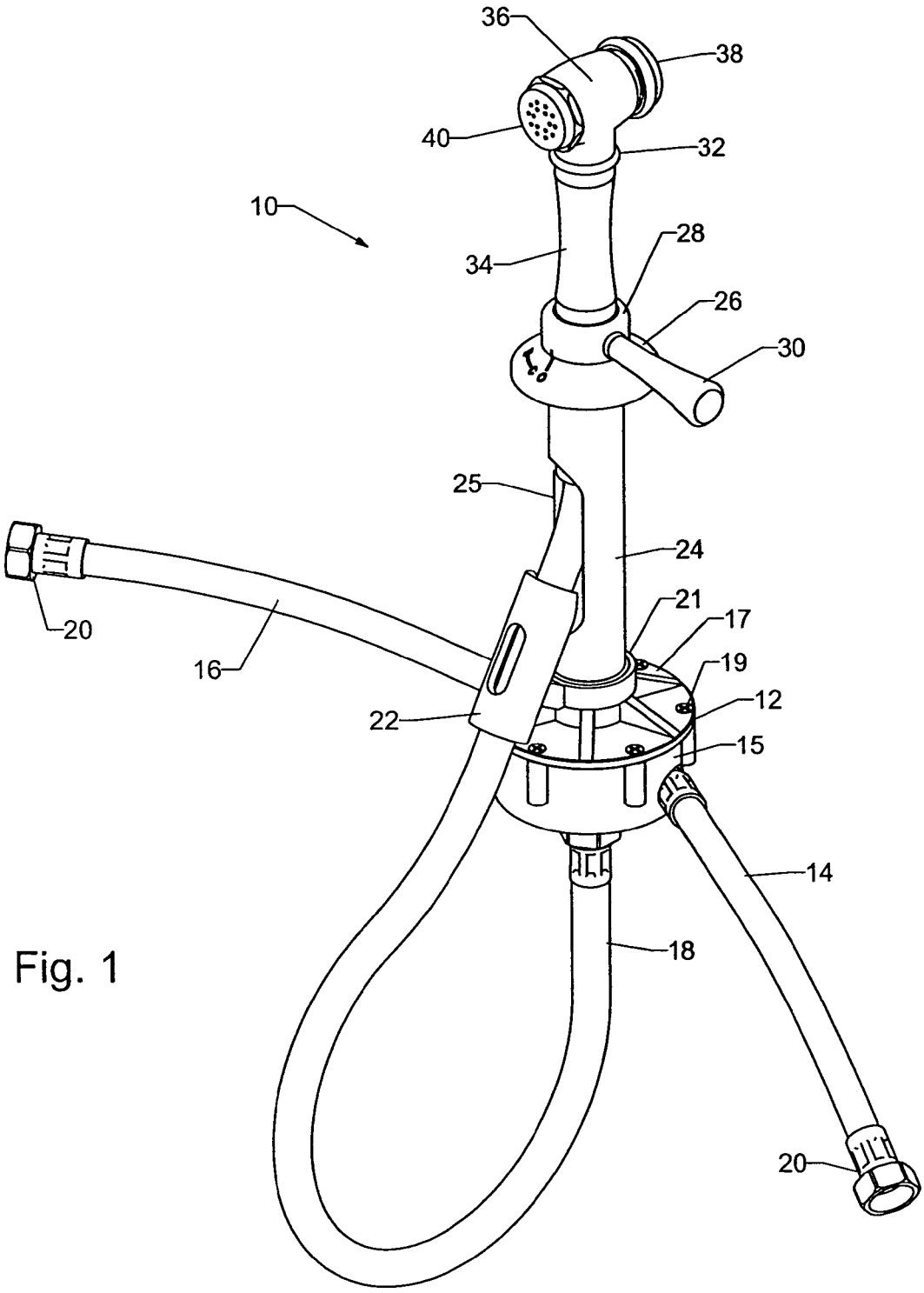
FIG. 1 shows a perspective view of a hand spray device which is a first embodiment of the invention.
Figure 2:
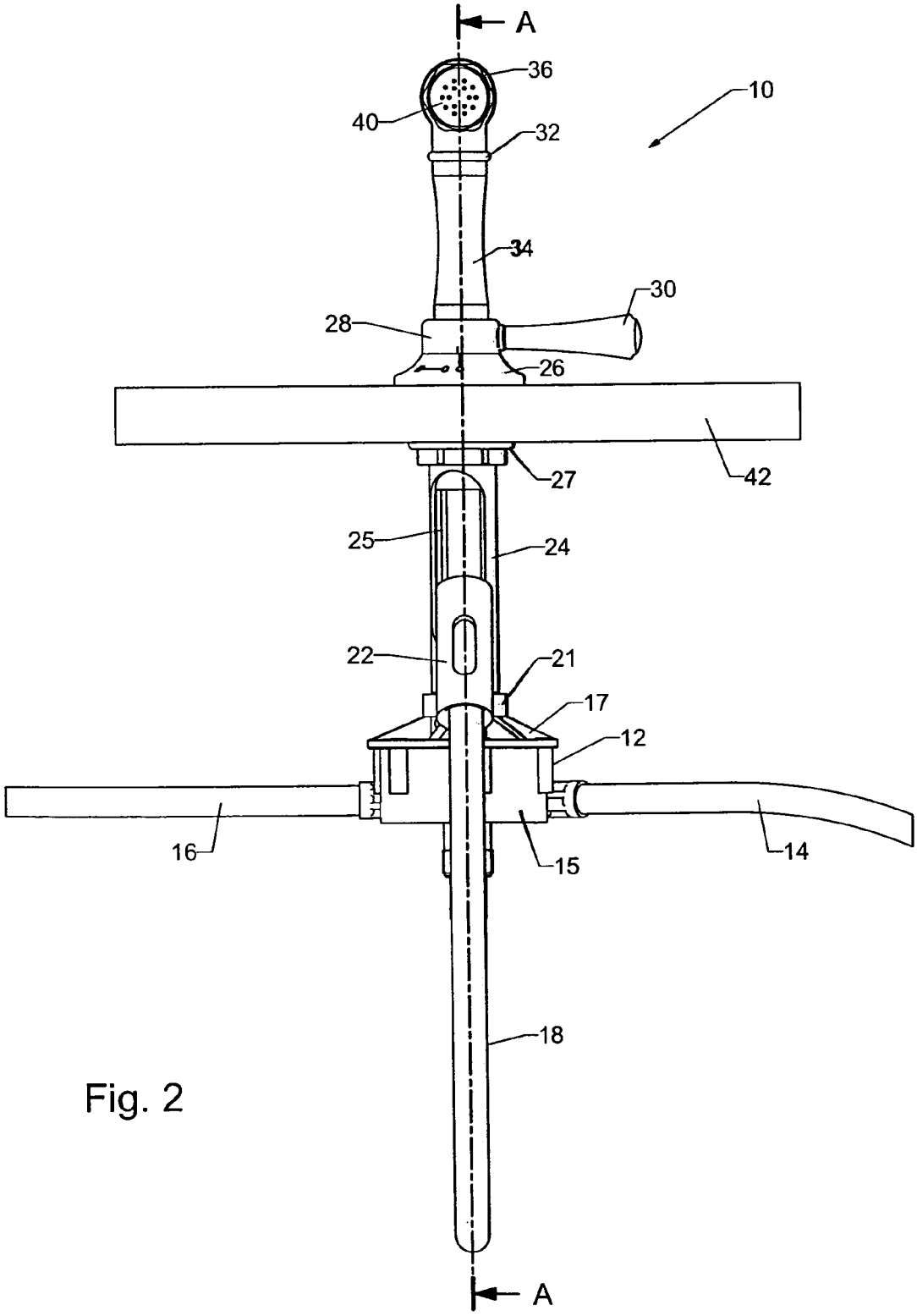
FIG. 2 shows a front view of the hand spray device of FIG. 1 mounted on a work surface.

FIGS. 1 and 2 show a first hand spray device 10 which comprises two sections: a mixing chamber 12 and a spray unit 32. The mixing chamber 12 has a cylindrical body 15 with a lid 17 attached to it via screws 19 (received in corresponding recesses in the body 15). The body 15 has two input ports formed in its curved side surface; the ports are adapted to receive flexible hoses or pipes 14,16 from respective hot or cold water supplies, e.g. mains water or hot/cold water supplies to an existing household water appliance. Each pipe 14,16 has an end connector 20 for attaching to a suitable valve or supply. The body 15 has an output port formed in its bottom surface; a flexible output supply pipe 18 extends out of this port to feed water to the spray unit 32.

The spray unit 32 is removably mounted in an annular housing 26, which is connected to the mixing chamber 12 by a straight hollow tube 24. The tube 24 supports the mixing chamber 12 below the work surface. The output supply pipe 18 travels through a cut out hole 25 in the side of the tube 24 and terminates inside the spray unit 32 itself. To aid the direction of the output supply pipe 18, a tubular guide pipe 22 is mounted on the mixing chamber 12. The output supply pipe 18 passes through the guide pipe 22 before entering the cut out hole 25.

As shown in FIG. 2, the housing 26 is adapted to be mounted on a work surface 42, where it is secured in place using a backing nut 27. The housing 26 has a flat base arranged to lie flush with the top of the work surface 42. A hole in the work surface receives the tube 24 so that the mixing chamber 12 can be located under the work surface 42, e.g. out of sight of the user.

The spray unit 32 comprises a handle 34 for the user to grip, and a spray head 36 mounted on the handle 34. The spray head 36 has a push button operator 38 which controls fluid flow through nozzle 40. The output supply pipe 18 is threaded through the handle 34 to supply water at the spray head 36. The output supply pipe 18 is flexible and long to enable the spray unit 32 to be lifted away from the housing 26. The output supply pipe 18 slides up through the cut out hole 25 and through the middle of the housing 26 to accommodate this movement.

A rotatable input controller 28 is mounted on the housing 26. As explained in more detail below, the controller 28 is arranged to control the relative proportion of fluid from the input supply pipes 14,16 received in the mixing chamber 12. In the illustrated embodiment, the controller 28 is rotatable from an off position in which no fluid enters the mixing chamber 12 from either input supply pipe 14,16 through a full cold position where all the fluid entering the mixing chamber is from the cold supply pipe 14 to a full hot position where all the fluid entering the mixing chamber is from the hot supply pipe 16. Between the full cold and full hot position, a mix of the two inputs is received. The relative proportion of fluid from the two input supply pipes 14,16 is controlled according to the rotated angular position of the controller 28. Rotation of controller 28 is carried out using radially protruding handle 30.

Figure 3:
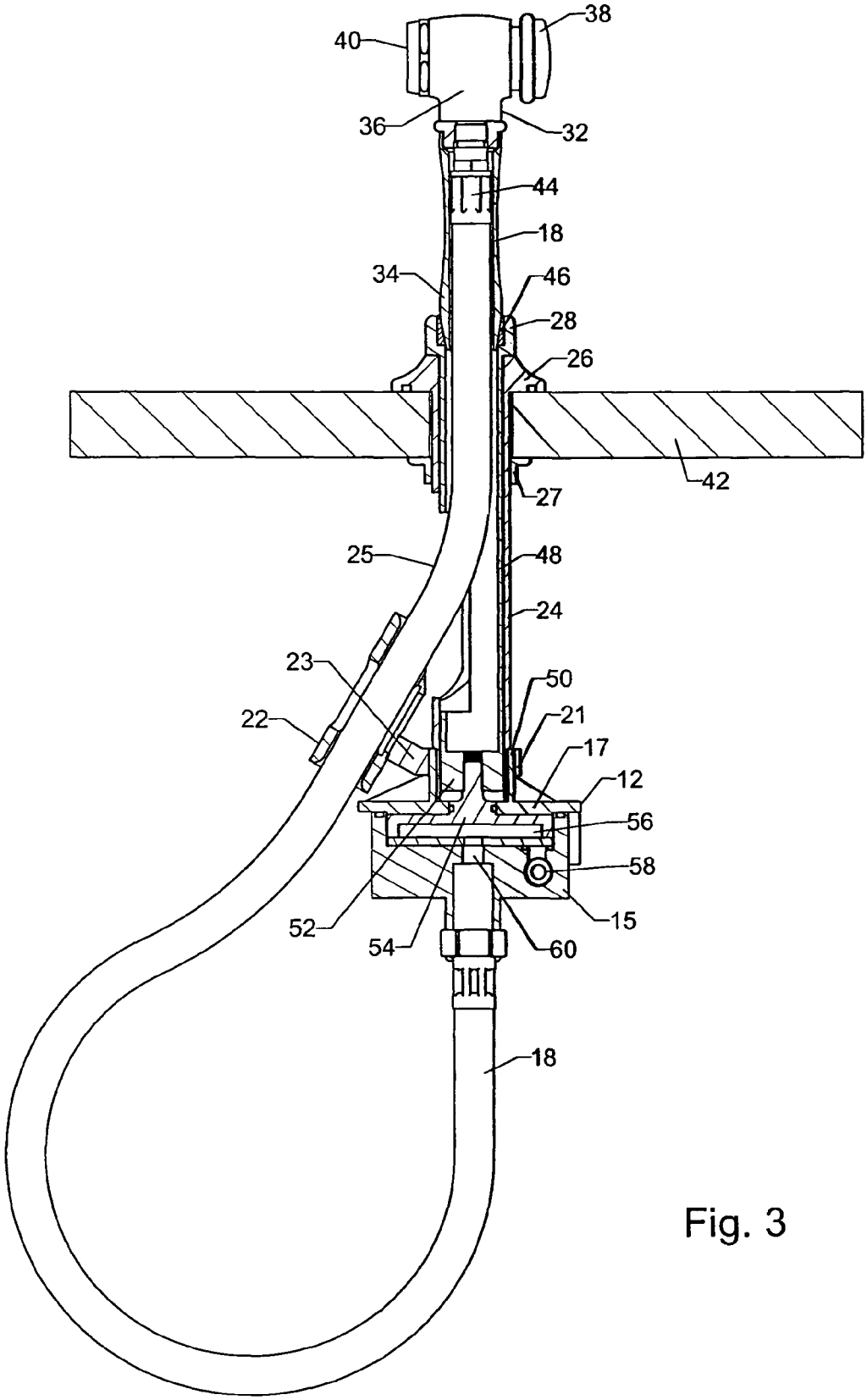
FIG. 3 shows a cross-sectional view taken along the line A-A in FIG. 2.

FIG. 3 shows a cross-sectional view of the device 10, which illustrates its inner workings. Output supply pipe 18 can be seen to travel through guide pipe 22 (attached to ring 21 via web 23, the ring 21 being mounted on an upstanding projection 50 on the mixing chamber 12) and cut out hole 25 into a passageway through housing 26 and controller 28 into handle 34, where it terminates in connector 44. The connection at the spray head 36 is conventional. The inner surface of controller 28 has a bearing 46 to prevent the spray head 32 rotating when the controller 28 is operated.

To operate the mixing chamber control, the controller 28 is attached to (or made integral with) a straight operator tube 48 which sits inside and coaxially with the hollow tube 24. The operator tube 48 is rotatable with the controller 28 relative to the tube 24 to turn valve plate 54, which is connected to the base 52 of the operator tube 48. The output supply pipe 18 travels to the spray head 32 through the operator tube 48. Thus, the operator tube 48 also has a cut out hole arranged to overlap with cut out hole 25. The cut out hole has a greater circumferential extent than the cut out hole 25 on outer tube 24 so that the output supply pipe 18 can be received without constraint in the operator tube 48 in all angular operating positions of the controller 28.

Figure 4:
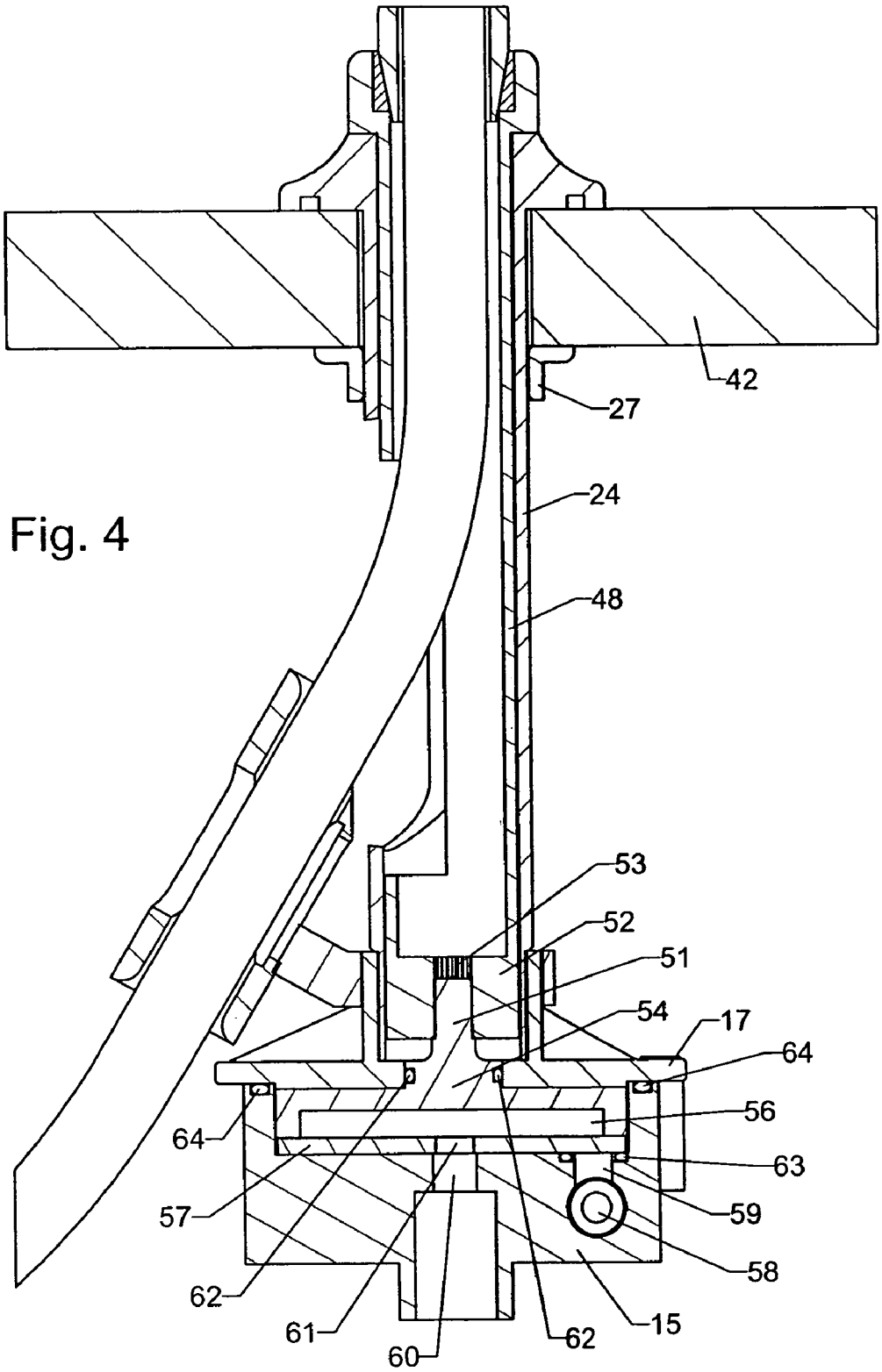
FIG. 4 shows a close-up view of the input controller and mixing chamber of FIG. 3.

FIG. 4 shows the interior of the mixing chamber 12 in more detail. Valve plate 54 has an upstanding splined projection 51 that slots into correspondingly splined through hole 53 in base 52 so that the valve plate 54 rotates with the operator tube 48. The valve plate 54 itself is received in the mouth of a cup formed by the base 15 of the mixing chamber 12. The cup is then covered by a lid 17, with an O-ring seal 64 at the joining edge to prevent leakage. The base of the upstanding projection 51 abuts the inwards facing surface of the lid 17 via O-ring seal 62 to prevent leakage into tube 24.

Figure 5:
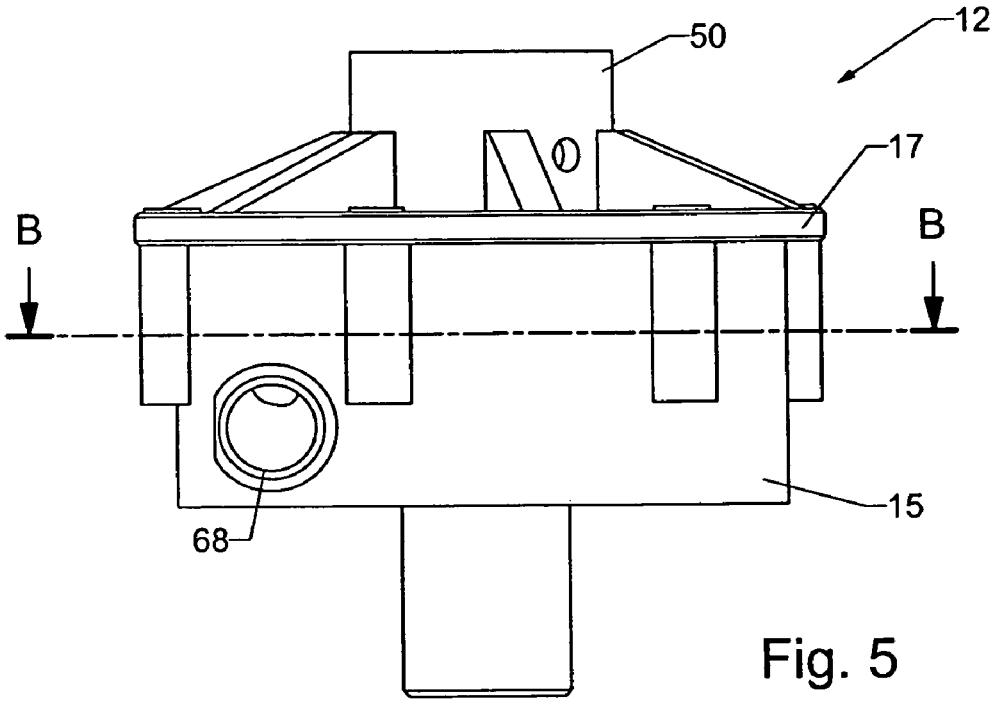
FIG. 5 shows a side view of the mixing chamber shown in FIG. 1.
Figure 6:
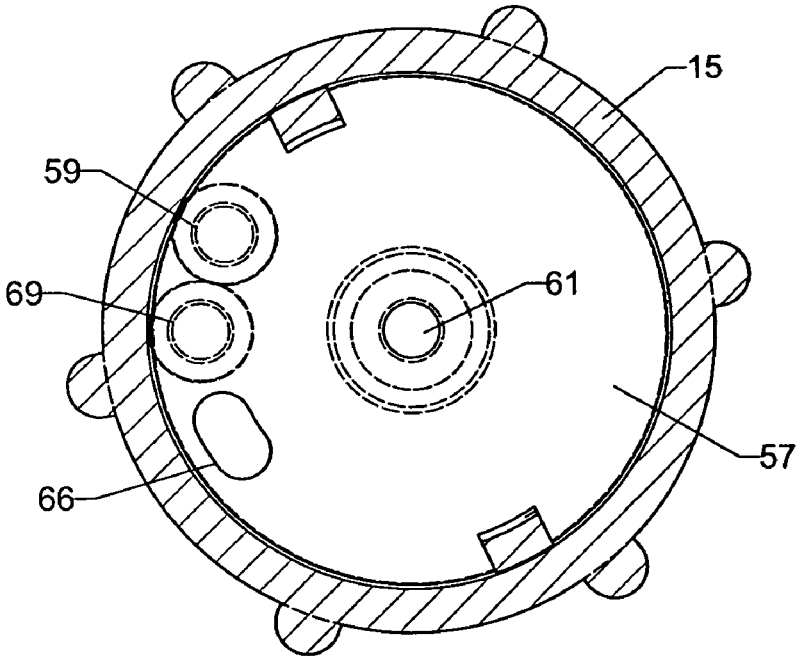
FIG. 6 is a cross-sectional view across the mixing chamber taken along the line B-B in FIG. 5.

Looking at FIGS. 4 to 6, the operation of the mixing chamber is now explained. The bottom of the cup formed by the base 15 of the mixing chamber has two input ports 59,69 and one output port 60. Output port 60 leads away from mixing volume 56 to the output supply pipe 18. Input ports 59,69 introduce fluid from input passages 58,68 (attached to input supply pipes 14,16) into mixing volume 56. Rotation of valve plate 54 controls flow control disc 57. Valve plate 54 and control disc 57 enclose mixing volume 56. Control disc 57 has a central hole 61 leading to output port 60 and a circumferential slot 66 extending around part of its periphery arranged to move over the input ports 59,69 to allow fluid into the mixing volume 56 according to the position of the controller 28. Thus, in the off position, the control disc 57 blocks both input ports 59,69, i.e. the slot 66 does not overlie either of the input ports 59,69 (see FIG. 6). An O-ring 63 is used to seal around the edge of each input port 59,69. In the full cold position, the slot 66 lies over the cold input port 69, whilst the hot input port 59 is still covered. In the full hot position, the slot 66 lies over the hot input port 59, whilst the cold input port 69 is covered. In between these positions, each port 59,69 is partially covered and partially exposed to give different relative proportions from the input pipes 14,16.

As an alternative to the control disc 57 abutting the O-ring 63 to seal the input port 59 as illustrated in FIG. 4, a pair of parallel ceramic plates may be used, e.g. as conventional known. In this case, the operator tube 48 would control relative rotation of the ceramic plates.

Figure 7:
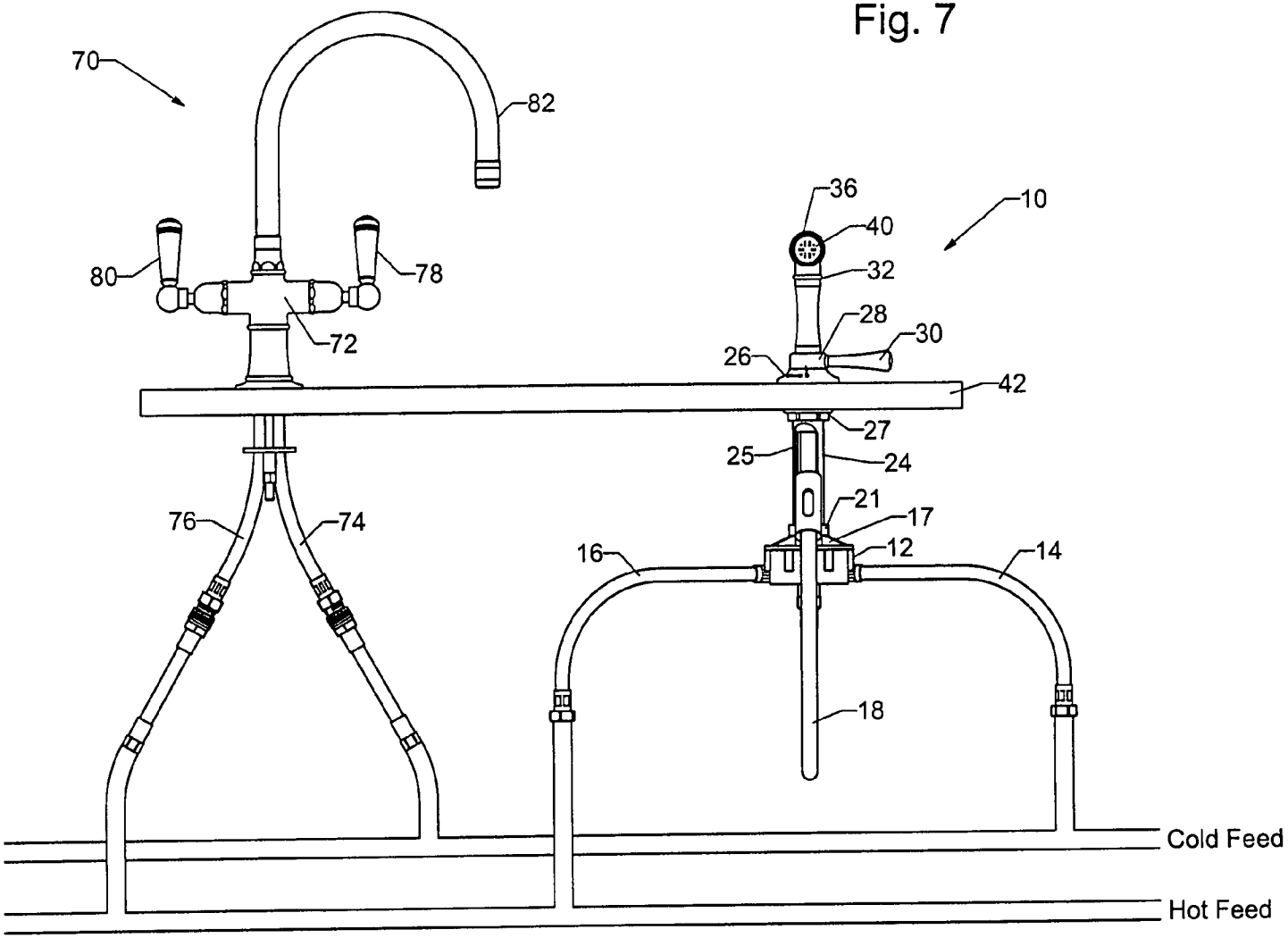
FIG. 7 shows front view of the hand spray device of FIG. 1 in use with a main tap unit.

FIG. 7 shows the spray device 10 in use with a main (primary) kitchen tap assembly 70. The illustrated tap assembly 70 is a simple mixer tap having a mixing chamber 72 mounted on the work surface 42. The mixing chamber is fed by two inputs 74,76 taken off the main fee pipes under the work surface 42. Fluid from the inputs 74,76 is controlled by operator handles 78,80 in the conventional way, so that mixed fluid is output through the tap nozzle 82. By having separate mixing chambers 12,72, each with its own temperature control (i.e. controller 28 and tap operators 78,80 respectively), the user has greater control over the whole system. By locating the hand spray mixing chamber below the work surface and integrating the output feed with the temperature control mechanism, the appearance of the whole assembly to the user (i.e. above the work surface) is uncluttered, which may be more aesthetically pleasing.

Figure 8:
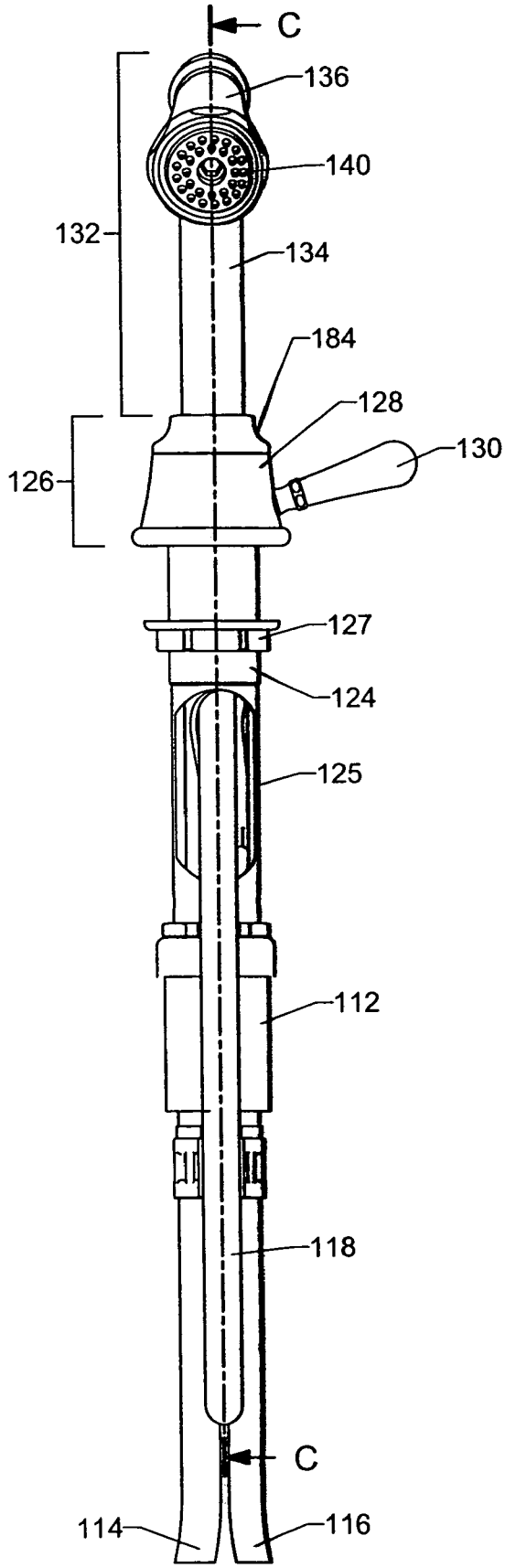
FIG. 8 shows a front view of a hand spay device which is a second embodiment of the invention.
Figure 9:
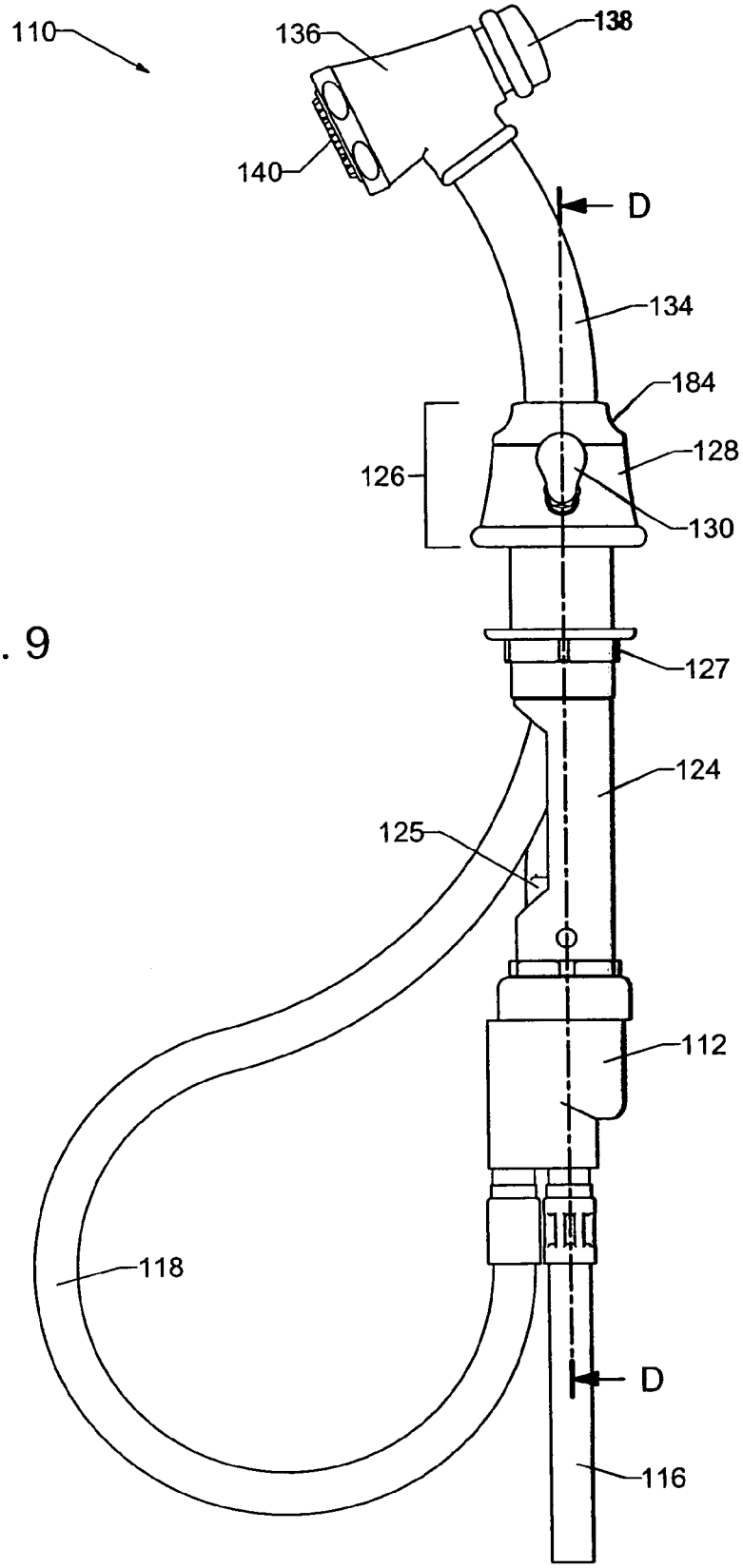
FIG. 9 shows a side view of the hand spray device shown in FIG. 8.

FIGS. 8 and 9 show a second hand spray device 110. The hand spray device 110 comprises a spray unit 132, a housing 126 for removably mounting the spray unit 132 and a mixing chamber 112. The spray unit 132 comprises a spray head 136 and a handle 134. The housing 126 is adapted to be mounted on a work surface (not shown). The housing 126 is connected to the mixing chamber 112 by a straight hollow tube 124 which passes through a hole in the work surface. The tube 124 supports the mixing chamber 112 below the work surface so that it is out of sight of a user.

Mixing chamber 112 is a compact, conventional mixing chamber having cartridge valves of the ceramic disc type and operates in the manner known to those in the art. It has two input ports adapted to receive flexible hoses or pipes 114, 116 from respective hot/cold water supplies and a flexible output supply pipe 118 to feed water to the spray unit 132. The output supply pipe 118 travels through a cut out hole 125 in the side of the tube 124 and is in fluid connection with the handle 134 of the spray unit 132.

The housing 126 comprises a rotatable input controller 128 and a fixed seat 184 for holding the bottom 194 of the spray unit 132. A handle 130 is attached to the input controller 128. Rotation of the input controller 128, using the handle 130, allows a user to control the flow and/or temperature of the water supply to the spray unit 132 (the input controller 128 is connected to the mixing chamber 112 in the manner described below). The housing 126 has a flat bottom so that it lies flush with the work surface. A hole in the work surface receives the tube 124. A backing nut 127 attaches the housing 126 to the work surface via the hollow tube 124.

The handle 134 is curved so that the spray head 136 is inclined downwards when mounted in the housing, so that the spray unit 132 directs water into a sink (not shown) if the device 110 is turned on prior to the spray unit 132 being lifted from the housing. This enables a user to adjust the flow and/or temperature settings of the water flow, prior to lifting the spray unit 132 from the housing 126, without unnecessary spillage of water.

The spray head 136 comprises a pause button 138. The pause button 138 can be pressed to an "in" position by a user to stop the flow of water through the spray unit 132. A not pressed (i.e. an "out") position of the pause button 138 allows water to flow through the spray unit 132. An internal spring 214 (see FIG. 10*b*) biases the pause button 138 to its "out" position so that spray head 136 allows water to flow through the spray unit 132 when the button 138 is not pressed. This ensures that a user turns off the spray device 110 using the input controller 128 rather than using the spray unit 132. This is advantageous because it helps to prevent a user leaving the output supply pipe 118 and the spray unit 132 in a pressurised situation when the device 110 is not being used.

Figure 10A:
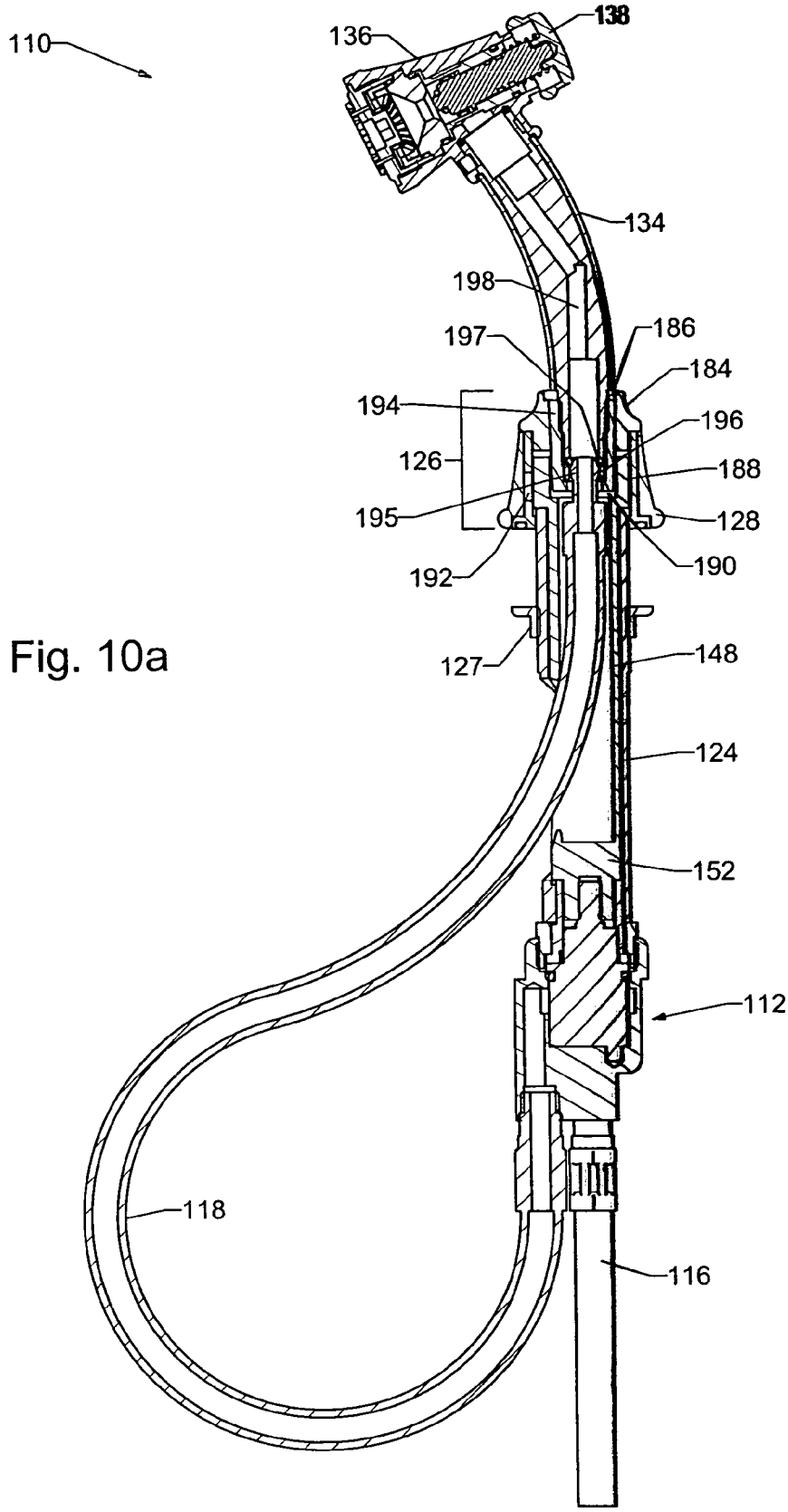
FIG. 10*a* is a cross-sectional view taken along the line A-A in FIG. 8.
Figure 10B:
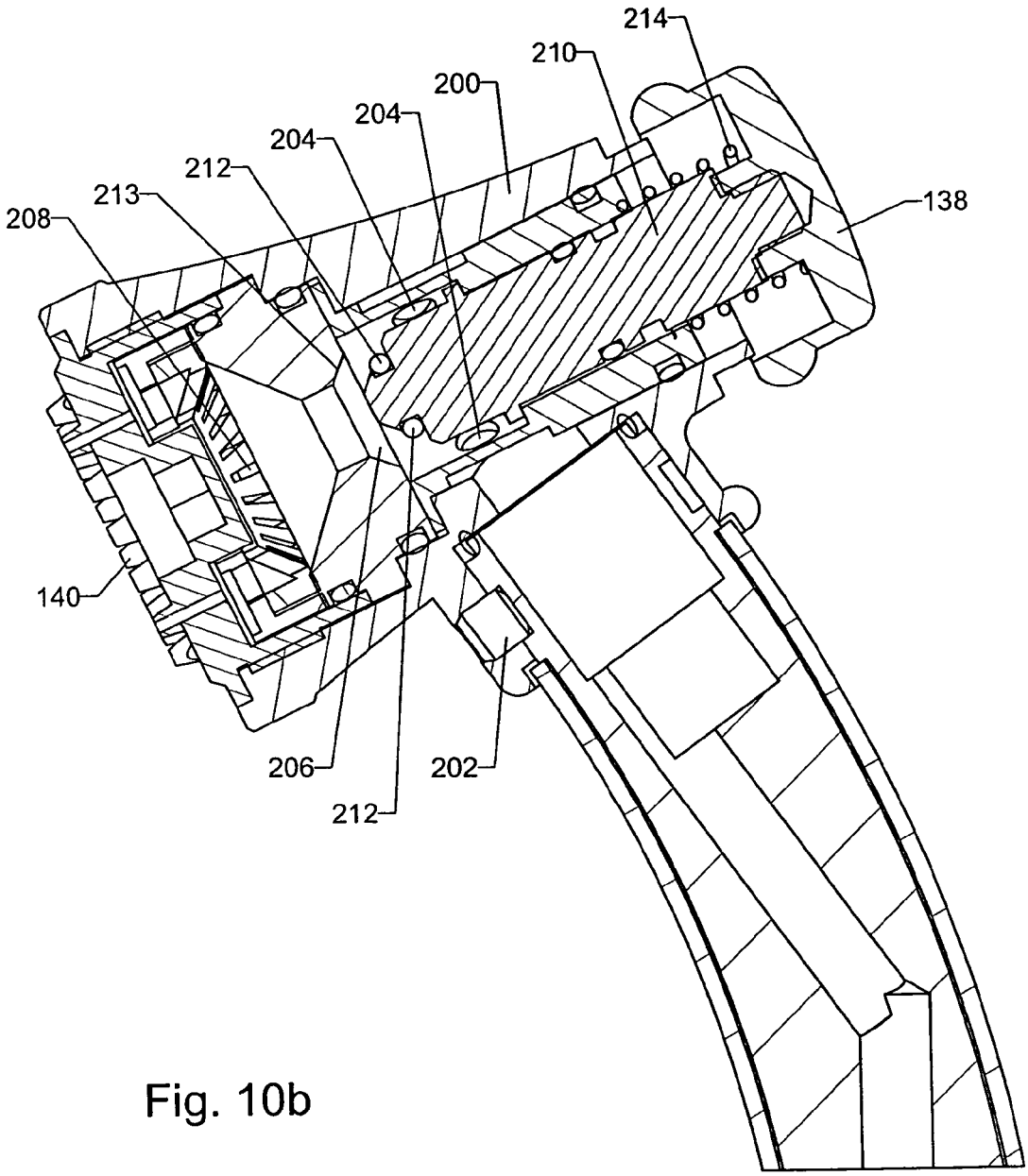
FIG. 10*b* shows an enlarged view of the spray head shown in FIG. 10*a;*
Figure 11:
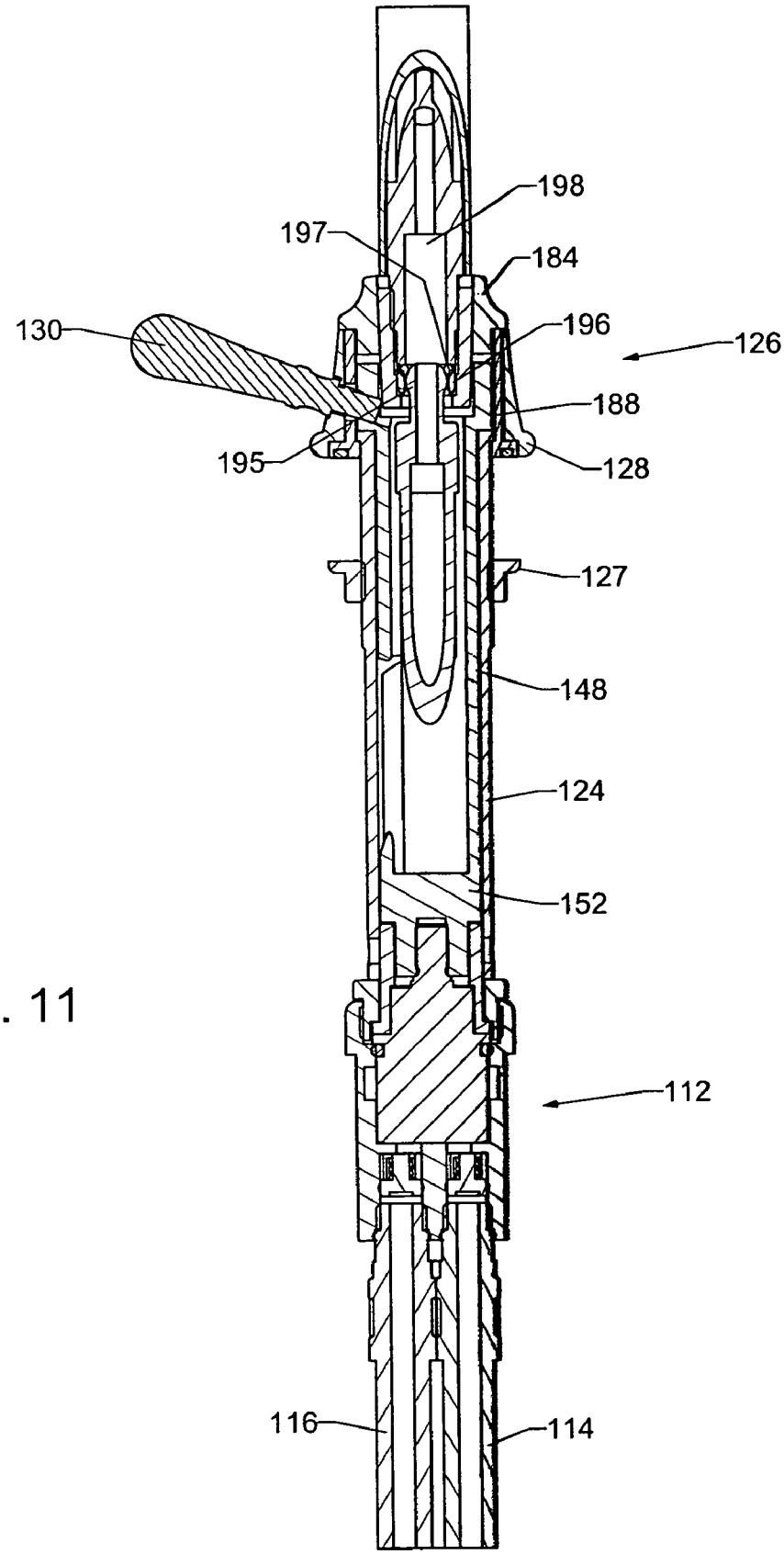
FIG. 11. shows a cross-sectional view taken along the line C-C in FIG. 9.

FIGS. 10 and 11 are cross sectional views of the spray device 110 taken along the line A-A in FIG. 9 and the line C-C in FIG. 8 respectively and show the inner workings of the second embodiment.

The housing 126 is fixed to the work surface through an annular internal structure 188. The input controller 128 is rotatably mounted on the structure 188 whereas the seat 184 is fixed to the structure 188. The handle 130 of the input controller 128 is attached to (or made integral with) the top of the operator tube 148 so that movement of the handle 130 effects rotation of both the input controller 128 and the operator tube 148. The structure 188 comprises a circumferential recess 192 for accommodating rotational movement of the handle 130.

The operator tube 148 sits inside and coaxially with the hollow tube 124. The operator tube 148 comprises a cut-out hole arranged to overlap with the cut out hole 125 of the hollow tube 124. The cut-out hole of the operator tube 148 has a greater extent than the cut-out hole 125 of the hollow tube 124 so that the output supply pipe 118 can be received without constraint in the operator tube 148 in all rotational positions of the input controller 128.

The operator tube 148 is connected to a central member 154 of the mixing chamber 112 so as to control the output of water from the mixing chamber 112 through the output supply pipe 118 in the conventional manner. In this embodiment, the mixing chamber 112 is configured so that a user can, upon rotation of the input controller 128 from an "off" position, firstly control the volume of flow of cold water and then control the temperature of full-flow mixed hot and cold water (by adjusting the relative proportions of hot and cold water).

The bottom 194 of the spray unit 132 is made of a soft material (e.g. rubber) and is removably held by the fixed seat 184 of the housing 126. A mounting ring 186 ensures that the bottom 194 is held at the intended depth in a cavity 190 located in the housing 126. The bottom 194 of the spray unit 132 is tapered so that it does not contact the top of the operator tube 148 when it is held by the seat 184. Therefore, rotation of the input controller 128 does not result in rotation of the spray unit 132.

The distal ball-shaped end 195 of the output supply pipe 118 is in fluid communication with the interior piping 198 of the handle 134. The interior piping 198 provides fluid communication through the handle 134 to the spray head 136. The interior piping 198 includes a bend to account for the curve of the handle 134. A sealing ring 197 ensures that the connection between the interior piping 198 and the supply pipe 118 is water tight. The handle 134 is connected to the end 195 of the output supply pipe 118 via an annular connector 196 which permits the spray unit 132 to be angularly orientable relative to the supply pipe 118. This offers improved directional control of spray from the spray unit 132 to a user, without unnecessary bending/twisting of the supply pipe 118.

The spray head 136 (shown in detail in FIG. 10*b*) has an outer casing 200 which is attached to the handle 134 by grub screw 202. Water enters the interior of the spray head 136 through holes 204, passes through an interior cavity 206, then through a dispersion unit 208 and leaves through the nozzle 140. A plunger 210 is mounted in the interior of the spray head 136. The plunger 210 has a rubber sealing ring 212 at its front which is adapted to plug the interior cavity 206. The plunger 210 is held in the interior of the spray head 136 and is fixed to the button 138. An internal spring 214 biases the button 138 and the plunger 210 to a position in which the plunger 210 does not plug the interior cavity 206. A user pressing button 138 will cause the sealing ring 212 of the plunger 210 to abut against an internal annular surface 213 so that cavity 206 is plugged by the plunger 210. Upon releasing the button 138, the internal spring 214 will return the button 138 and plunger 210 to their original positions so that the flow of water is allowed to resume. Therefore, the spray unit 136 allows a user to temporarily pause the flow of water through the spray head by holding down the button 138.

The spray device 110 can be assembled in a kitchen tap assembly in a similar manner to the first embodiment (e.g. as shown in FIG. 7).

What is claimed is:

1. A spray device for use as a supplementary fluid output, the spray device including:

mounting means for attaching the spray device to a work surface, the mounting means having a bore extending therethrough;

a spray head, the spray head being positioned above the mounting means and arranged to output a user-directable fluid flow;

a mixing chamber, the mixing chamber being positioned below the mounting means and arranged to receive and mix fluid from at least two fluid input supplies;

a flexible outlet conduit, the flexible outlet conduit providing fluid communication from the mixing chamber to the spray head, to provide a fluid output supply to the spray head; and a mix controller having a mix actuator and a mix control means, the mix actuator being positioned above the mounting means and arranged to operate the mix control means, the mix control means being communicable with one or more mix valves associated with the mixing chamber, to control the relative proportions of the fluid input supplies received in the mixing chamber;

wherein the mix control means and the flexible outlet conduit pass through the bore of the mounting means, wherein the flexible outlet conduit is slidable relative to the bore of the mounting means, wherein the mixing chamber includes a mixing space for mixing the input supplies, wherein one of the one or more mix valves comprises a rotatable control disc which acts as a barrier between the fluid input supplies and the mixing space, wherein the control disc includes at least one slot formed therein, the slot being arranged to align with input supply ports according to rotation angle of the control disc, to permit fluid from the input supply ports entering the mixing space, and wherein the control disc includes an output hole in fluid communication with the flexible outlet conduit, to allow fluid to exit the mixing space.

2. A spray device for use as a supplementary fluid output, the spray device including:

mounting means for attaching the spray device to a work surface, the mounting means having a bore extending therethrough;

a spray head, the spray head being positioned above the mounting means and arranged to output a user-directable fluid flow;

a mixing chamber, the mixing chamber being positioned below the mounting means and arranged to receive and mix fluid from at least two fluid input supplies;

an output conduit, the output conduit providing fluid communication from the mixing chamber to the spray head, to provide a fluid output supply to the spray head; and a mix controller having a mix actuator and a mix control means, the mix actuator being positioned above the mounting means and arranged to operate the mix control means, the mix control means being communicable with one or more mix valves associated with the mixing chamber, to control the relative proportions of the fluid input supplies received in the mixing chamber;

wherein:

the mix control means and the output conduit pass through the bore of the mounting means;

the mounting means includes a housing, the spray head being detachably mountable on the housing;

the mix actuator is mounted on the housing; and the mix actuator is a rotatable ring through which the output conduit passes.

3. A spray device according to claim 2 wherein the output conduit between the spray head and mixing chamber is a flexible conduit.

4. A spray device for use as a supplementary fluid output, the spray device including:

mounting means for attaching the spray device to a work surface, the mounting means having a bore extending therethrough;

a spray head, the spray head being positioned above the mounting means and arranged to output a user-directable fluid flow;

a mixing chamber, the mixing chamber being positioned below the mounting means and arranged to receive and mix fluid from at least two fluid input supplies;

an output conduit, the output conduit providing fluid communication from the mixing chamber to the spray head, to provide a fluid output supply to the spray head; and a mix controller having a mix actuator and a mix control means, the mix actuator being positioned above the mounting means and arranged to operate the mix control means, the mix control means being communicable with one or more mix valves associated with the mixing chamber, to control the relative proportions of the fluid input supplies received in the mixing chamber;

wherein:

the mix control means and the output conduit pass through the bore of the mounting means;

the mix control means is a physical connection to the one or more mix valves such that operation of the mix actuator is directly transferred to operation of the one or more mix valves; and the physical connection is an upstanding sleeve rotatable about an axis and the output conduit passes through the sleeve.

5. A spray device according to claim 4 wherein the sleeve has an axially extending opening and the output conduit passes through the axially extending opening.

6. A spray device for use as a supplementary fluid output, the spray device including:

mounting means for attaching the spray device to a work surface, the mounting means having a bore extending therethrough;

a spray head, the spray head being positioned above the mounting means and arranged to output a user-directable fluid flow;

a mixing chamber, the mixing chamber being positioned below the mounting means and arranged to receive and mix fluid from at least two fluid input supplies;

a flexible outlet conduit, the flexible outlet conduit providing fluid communication from the mixing chamber to the spray head, to provide a fluid output supply to the spray head; and a mix controller having a mix actuator and a mix control means, the mix actuator being positioned above the mounting means and arranged to operate the mix control means, the mix control means being communicable with one or more mix valves associated with the mixing chamber, to control the relative proportions of the fluid input supplies received in the mixing chamber;

wherein the mix control means and the flexible outlet conduit pass through the bore of the mounting means, wherein the flexible outlet conduit is slidable relative to the bore of the mounting means, and additionally comprising a flow controller having a flow actuator and a flow control means, the flow actuator being positioned above the mounting means and arranged to operate the flow control means, the flow control means being communicable with one or more flow valves associated with the mixing chamber, to control the rate of fluid flow through the device, wherein the flow control means passes through the bore of the mounting means.

7. A spray device according to claim 6, wherein the mounting means includes a housing, the spray head being detachably mountable on the housing.

8. A spray device according to claim 7 wherein the mix actuator is mounted on the housing.

9. A spray device according to claim 6, wherein the mix control means is a physical connection to the one or more mix valves such that operation of the mix actuator is directly transferred to operation of the one or more mix valves.

10. A spray device according to claim 6, wherein the mixing chamber includes a mixing space for mixing the input supplies and one of the one or more mix valves comprises a rotatable control disc which acts as a barrier between the fluid input supplies and the mixing space.

11. A spray device according to claim 10 wherein the control disc includes at least one slot formed therein, the slot being arranged to align with input supply ports according to rotation angle of the control disc, to permit fluid from the input supply ports entering the mixing space.

12. A spray device according to claim 11 wherein the control disc includes an output hole in fluid communication with the flexible outlet conduit, to allow fluid to exit the mixing space.

13. A spray device according to claim 6, wherein the mix controller additionally controls the rate of fluid flow through the device.

14. A spray device according to claim 6, wherein the spray head comprises a pause valve, the pause valve having an on state in which liquid is able to flow through the spray head and an off state in which liquid is not able to flow through the spray head, the pause valve being biased to the on state.

15. A spray device assembly comprising:

a spray device; and a work surface, the work surface having a hole therein;

the spray device including:

mounting means for attaching the spray device to the work surface, the mounting means having a bore extending therethrough;

a spray head, the spray head being positioned above the mounting means and arranged to output a user-directable fluid flow;

a mixing chamber, the mixing chamber being positioned below the mounting means and arranged to receive and mix fluid from at least two fluid input supplies;

a flexible outlet conduit, the flexible outlet conduit providing fluid communication from the mixing chamber to the spray head, to provide a fluid output supply to the spray head; and a mix controller having a mix actuator and a mix control means, the mix actuator being positioned above the mounting means and arranged to operate the mix control means, the mix control means being communicable with one or more mix valves associated with the mixing chamber, to control the relative proportions of the fluid input supplies received in the mixing chamber;

wherein:

the mounting means of the spray device is mounted on the hole in the work surface with the bore of the mounting means aligned with the hole;

the mixing chamber is positioned below the work surface;

the spray head and the mix actuator are positioned on or above the work surface;

the flexible outlet conduit and the mix control means pass through the hole in the work surface and the bore of the mounting means; and the flexible outlet conduit is slidable relative to the bore of the mounting means; and wherein the spray device additionally includes a flow controller having a flow actuator and a flow control means, the flow actuator being positioned above the mounting means and arranged to operate the flow control means, the flow control means being communicable with one or more flow valves associated with the mixing chamber, to control the rate of fluid flow through the device, wherein the flow control means passes through the bore of the mounting means.

16. A spray device assembly comprising:

a spray device;

a work surface, the work surface having a hole therein;

a main tap outlet; and at least two fluid sources;

the spray device including:

mounting means for attaching the spray device to the work surface, the mounting means having a bore extending therethrough;

a spray head, the spray head being positioned above the mounting means and arranged to output a user-directable fluid flow;

a mixing chamber, the mixing chamber being positioned below the mounting means and arranged to receive and mix fluid from the at least two fluid input supplies;

a flexible outlet conduit, the flexible outlet conduit providing fluid communication from the mixing chamber to the spray head, to provide a fluid output supply to the spray head; and a mix controller having a mix actuator and a mix control means, the mix actuator being positioned above the mounting means and arranged to operate the mix control means, the mix control means being communicable with one or more mix valves associated with the mixing chamber, to control the relative proportions of the fluid input supplies received in the mixing chamber;

wherein:

the mounting means of the spray device is mounted on the hole in the work surface with the bore of the mounting means aligned with the hole;

the mixing chamber is positioned below the work surface;

the spray head, the main tap outlet and the mix actuator are positioned on or above the work surface;

the flexible outlet conduit and the mix control means pass through the hole in the work surface and the bore of the mounting means;

the mixing chamber is connected to the fluid sources by a first connection, the main tap outlet is connected to at least one of the fluid sources by a second connection and the first and second connections are separate from each other; and the flexible outlet conduit is slidable relative to the bore of the mounting means; and wherein the spray device additionally includes a flow controller having a flow actuator and a flow control means, the flow actuator being positioned above the mounting means and arranged to operate the flow control means, the flow control means being communicable with one or more flow valves associated with the mixing chamber, to control the rate of fluid flow through the device, wherein the flow control means passes through the bore of the mounting means.

17. A spray device according to claim 4 wherein the output conduit between the spray head and mixing chamber is a flexible conduit.

* * * * *